US005866507A

United States Patent [19]

Suzaki et al.

[11] Patent Number: 5,866,507

[45] Date of Patent: Feb. 2, 1999

[54] THERMOSENSITIVE RECORDING MATERIAL

[75] Inventors: Hideo Suzaki, Numazu; Hideo Aihara, Fuji, both of Japan

[73] Assignee: Ricoh Company, Ltd., Tokyo, Japan

[21] Appl. No.: 891,239

[22] Filed: Jul. 10, 1997

[30] Foreign Application Priority Data

Jul. 18, 1996 [JP] Japan ..... 8-207842

[51] Int. Cl.[6] ..... B41M 5/36; B41M 5/40

[52] U.S. Cl. ..... 503/207; 427/152; 503/200; 503/226

[58] Field of Search ..... 427/150–152; 503/200, 207, 226

[56] References Cited

U.S. PATENT DOCUMENTS 5,229,349 7/1993 Kurisu et al. ..... 503/200
5,447,900 9/1995 Suzaki et al. ..... 503/207
5,482,911 1/1996 Hiroishi et al. ..... 503/200
5,482,912 1/1996 Furuya et al. ..... 503/226

*Primary Examiner*—Bruce H. Hess
*Attorney, Agent, or Firm*—Cooper & Dunham LLP

[57] ABSTRACT

A thermosensitive recording material is provided which includes a substrate, a thermosensitive recording layer formed on the substrate and including a binder resin, a coloring agent and a coloring developer inducing color formation in the coloring agent upon application of heat thereto, and a protective layer formed on the thermosensitive recording layer and including a resin, wherein the protective layer includes a particulate organic filler (A) whose average particle diameter is from about 1.2 to about 3.0 times the thickness of the protective layer and a particulate organic filler (B) having an average particle diameter of from about 0.05 to about 0.7 $\mu$m. The thermosensitive recording material has good image qualities without undesired white streaks and good ability to be used with thermal printheads without sticking to and wearing out the thermal printheads.

17 Claims, No Drawings

THERMOSENSITIVE RECORDING MATERIAL

BACKGROUND OF THE INVENTION

1. Field of the Invention

The present invention relates to a thermosensitive recording material, and more particularly to a thermosensitive recording material which forms a colored image as a result of a chemical coloring reaction of an electron donating coloring agent with an electron accepting coloring developer.

2. Discussion of the Related Art

A thermosensitive recording material is well known in which a colored image is formed by a chemical coloring reaction of a colorless or a pale colored coloring agent, such as an electron donor, e.g., a leuco dye having a lactone, a lactam or a spiropyran ring, with a coloring developer, such as an electron acceptor, e.g., an organic acid or a phenolic compound, wherein color formation is induced when the coloring agent and the coloring developer are subjected to heat or the like.

The thermosensitive recording material has the following advantages over other conventional recording media:

(1) color images can rapidly be recorded by a relatively simple apparatus without using such complicated steps as developing and fixing;

(2) color images can be recorded without producing noise and environmental pollution;

(3) various color images, e.g., red, blue, violet and black, can easily be obtained;

(4) image density and background whiteness are high; and (5) the manufacturing cost is low.

Because of these advantages, the above-described thermosensitive recording material can be widely used, not only as a recording material for price labels in stores, but also as recording materials for copiers, printers for computers, facsimiles, automatic vending machines of labels and tickets, video printers and measuring instruments.

These thermosensitive recording materials generally include a thermosensitive recording layer (hereinafter referred to as recording layer) which is formed on a paper substrate and includes a coloring agent and a coloring developer. Recently, since the thermosensitive recording material is required to have good image qualities such as high resolution, the surface of the thermosensitive recording material tends to be enhanced in smoothness, for example, by forming an undercoat layer between a substrate and a recording layer. In addition, as the uses of the thermosensitive recording material grow, it is required to be used for document sheets for over head projection (OHP) or print output sheets for video printers. These thermosensitive recording materials are required to have a plastic film substrate and a smooth recording layer in order to produce an image having good image qualities.

When such a smooth recording layer including materials used for conventional recording layers is formed on a smooth surface of a plastic film substrate, the recording layer exhibits good image density because the contact between the recording layer and a thermal printhead is fairly good; however, the following problems tend to occur:

(1) sticking occurs in which the surface of the recording layer sticks to the thermal printhead because of the good contact of the recording layer and the thermal printhead, thereby deteriorating image qualities or feeding properties of the thermosensitive recording materials;

(2) the thermal printhead easily wears out when an inorganic filler is added to the recording layer in order to decrease the sticking; and (3)a part or a component of the recording layer is melted or softened and toughly adhered to the thermal printhead due to the heat applied for recording images, resulting in occurrence of undesired white streaks in the recorded images because the part of the thermal printhead to which the extraneous substance is adhered has insufficient heat conduction.

In attempting to solve these problems, i.e., sticking and white streaks, thermosensitive recording materials having a protective layer which includes a filler and which is formed on the surface of the recording material are disclosed. For example, Japanese Laid-Open Patent Application No. 61-225095 discloses a thermosensitive recording material having a protective layer including an inorganic filler. As mentioned above, this thermosensitive recording material has the drawback that it easily wears out a thermal printhead. Japanese Laid-Open Patent Applications No. 58-025988 and 05-278334 disclose thermosensitive recording materials having a protective layer including an organic filler. These thermosensitive recording materials do not easily wear out a thermal printhead; however, they cannot prevent the occurrence of the sticking and the white streaks.

Because of these reasons, a need exists for a thermosensitive recording material having good image qualities without white streaks and good ability to be used with thermal printheads without shortening the life of the thermal printheads, i.e., without sticking to and wearing out the thermal printheads.

SUMMARY OF THE INVENTION

Accordingly, an object of the present is to provide a thermosensitive recording material having good image qualities without white streaks and good ability to be used with thermal printheads without sticking to and easily wearing out the thermal printheads.

To achieve such an object, the present invention contemplates the provision of a thermosensitive recording material which has a substrate, a recording layer formed on the substrate and including a binder resin, a coloring agent and a coloring developer which forms a color image by reacting with the coloring agent upon application of heat, and a protective layer formed on the recording layer and including a resin, wherein the protective layer includes a particulate organic filler (A) having an average particle diameter about 1.2 to about 3.0 times the thickness of the protective layer and a particulate organic filler (B) having an average particle diameter of from about 0.05 to about 0.7 $\mu$m. The average particle diameter of filler (A) is larger than that of filler (B)

Preferably, the ratio of the organic filler (A) to an organic filler (B) is from about 1:100 to about 1:20by weight. In addition, the ratio of the binder resin to the total amount of the organic fillers (A) and (B) is preferably from about 1 0.5 to about 1:6 by weight.

Further, at least one of the organic fillers (A) and (B) preferably includes a guanamine-formaldehyde copolymer which is represented by the following formula (I):

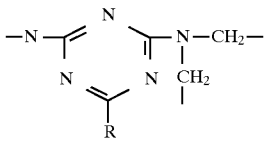

(I)

wherein R represents H, $CH_3$, $C_2H_5$, $C_3H_7$, $C_4H_9$, $NH_2$, $NO_2$, an acetyl group, $C_6H_{11}$, $C_6H_5$, a benzyl group or a methylphenyl group.

Still further, the resin of the protective layer includes preferably a polyvinyl acetoacetal resin having a degree of polymerization more than about 2,000 and the protective layer further includes an isocyanate type crosslinking agent which crosslinks the polyvinyl acetoacetal resin.

Furthermore, the smoothness of the surface of the thermosensitive recording material on which the protective layer is formed is preferably greater than about 5,000 sec.

These and other objects, features and advantages of the present invention will become apparent upon consideration of the following description of the preferred embodiments of the present invention.

DESCRIPTION OF THE PREFERRED EMBODIMENTS

The thermosensitive recording material of the present invention has a substrate, a recording layer formed on the substrate and a protective layer formed on the recording layer. The structure of the thermosensitive recording material of the present invention need not be limited to this structure. For example, an intermediate layer may be formed between the substrate and the recording layer. The recording layer includes a binder resin, a coloring agent and a coloring developer which forms a color image by reacting with the coloring agent upon application of heat. The protective layer is formed on the recording layer to make the thermosensitive recording material resistant to heat of a recording device such as a thermal printhead and to make the thermosensitive recording material and recorded images resistant to chemicals, water, light and rubbing.

The protective layer of the thermosensitive recording material of the present invention includes a relatively large particulate organic filler having an average particle diameter about 1.2 to about 3.0 times the thickness of the protective layer and a relatively small particulate organic filler having an average particle diameter of from about 0.05 to about 0.7 μm. The thermosensitive recording material of the present invention can produce good images without white streaks and without sticking to or wearing out a thermal printhead. Since organic fillers are relatively soft compared with inorganic fillers, it is effective for preventing wearout of a thermal printhead to use them in the protective layer. In addition, it is considered that particles of the relatively large organic filler whose top parts protrude through the surface of the protective layer decrease the contact areas between a thermal printhead and the protective layer, resulting in prevention of the thermosensitive recording material from sticking to the thermal printhead. Further, it is considered that the relatively small organic filler makes the surface of the protective layer appropriately slippery by reducing contact areas of the protective layer and the thermal printhead, thereby preventing the protective layer from adhering to the thermal printhead, and therefore undesired white streak images caused by adhesion of a part of the protective layer to the thermal printhead can be prevented. If the surface of a thermosensitive recording material is too slippery, a foreign particle or dust which happens to come into the image recording section stays between the thermal printhead and the surface of the thermosensitive recording material, thereby also causing white steak images. Even in this case, since the surface of the thermosensitive recording material of the present invention is appropriately slippery, i.e., not too slippery, the foreign particle or dust can be removed from the image recording section by the surface of the protective layer of the feeding thermosensitive recording material, resulting in prevention of undesired white streak images.

Suitable organic fillers for use in the protective layer of the thermosensitive recording material of the present invention include crosslinked polystyrene resins, melamine-formaldehyde resins, urea-formaldehyde resins, silicone resins, crosslinked polymethyl methacrylate resins, guanamine-formaldehyde resins and surface treated resins thereof. These fillers are employed alone or in combination. Among these resins, guanamine-formaldehyde resins and melamine-formaldehyde resins are preferable because the heat resistance thereof and the smoothness and friction coefficient of the surface of the protective layer including the resins can easily be controlled. Suitable particle shapes of the organic fillers include spherical and indeterminate forms but are not limited thereto.

A suitable average particle diameter of the organic fillers depends on the thickness of the protective layer in order to control the shape of the surface of the protective layer. The average particle diameter of the relatively large organic filler is preferably from about 1.2 to about 3.0 times the thickness of the protective layer, and more preferably from about 1.2 to about 2.0 times the thickness of the protective layer to maintain appropriate contacting area between the protective layer and a thermal printhead, namely to prevent sticking, and to maintain good image qualities such as dots reproducibility. The average particle diameter of the relatively small organic filler is preferably from about 0.05 to about 0.7 μm to maintain appropriate microscopic asperities which make the protective layer appropriately slippery; thereby good images without white streaks can be obtained.

The mixing ratio of the relatively large organic filler to the relatively small organic filler in the protective layer is preferably about 1:20 to about 1:100 by weight to prevent sticking and to maintain good image qualities such as dots reproducibility.

The mixing ratio of the binder resin to the total amount of the organic fillers in the protective layer is preferably from about 1:0.5 to about 1:6, and more preferably from about 1:1 to about 1:4, by weight to maintain good image qualities without white streaks, and to prevent sticking and peeling of the protective layer.

The protective layer preferably has appropriate microscopic asperities formed by the relatively small organic filler and dotted projections made by the relatively large organic filler. In order to make the surface of the protective layer be the desired shape, the surface on which the protective layer is formed preferably has a good smoothness, i.e., more than 5,000 sec. as measured with an Ohken smoothness tester.

Suitable resins for use in the protective layer include: poly(meth) acrylate resins, polyvinyl butyral resins, polyvinyl acetal resins, polyvinyl acetoacetal resins, ethylcellulose, methylcellulose, cellulose acetate, hydroxyethyl cellulose, cellulose acetate propionate, polyurethane resins, polyester resins, polyvinyl acetate resins, styrene-acrylate copolymers, polyolefin resins, polystyrene resins, polyvinyl chloride resins, polyether resins, polyamide resins, polycarbonate resins, polyethylene resins, polypropylene resins and polyacrylamide resins. In addition, silicone modified resins of these resins are preferably included in the protective layer alone or in combination with the above-mentioned resins to control the friction coefficient of the protective layer. Silicone modified resins are resins in which a resin is copolymerized with an organopolysiloxane compound having a siloxane bonding, an alkyl group such as a methyl group connecting a silicon atom thereof, and a reactive functional group, which is placed in or at the end of the molecule thereof, such as a hydroxy group, a carboxyl group, an epoxy group, an amino group, a mercapto group or the like.

The protective layer preferably includes a crosslinking agent which is conventionally known to be able to crosslink the above-mentioned resins. A suitable combination of a binder resin and a crosslinking agent in the protective layer of the thermosensitive recording material of the present invention is the combination of a polyvinyl acetal resin having a degree of polymerization more than 2,000 as a binder resin and an isocyanate compound as a crosslinking agent in view of the dispersibility of the organic fillers in the protective layer and heat resistance of the protective layer. Specific examples of the isocyanate compounds include isocyanate ccmpounds having two or more isocyanate groups in the molecule thereof, such as tolylenediisocyanate and dimers thereof, diphenylmethane diisocyanate, polymethylenepolyphenylisocyanate, hexamethylene diisocyanate, polyisocyanate and derivatives thereof.

In order to prevent sticking, the kinetic friction coefficient of the surface of the protective layer is controlled to be an appropriate value, for example, by one or more of the following methods:

(1) adding a wax to the protective layer;

(2) employing a silicone modified resin as a resin of the protective layer, if desired, together with other resin;

(3) adjusting the mixing ratio of the resin to the total amount of the organic fillers; and/or (4) changing the composition of the organic fillers.

Suitable waxes for use in the protective layer include stearic acid amide, palmitic acid amide, oleic acid amide, lauric acid amide, ethylenebisstearoamide, methylenebisstearoamide, methylolbisstearoamide, paraffin wax, polyethylene, carnauba wax, oxidized paraffin and zinc stearate.

The protective layer can be formed by a conventionally known manufacturing method as follows:

(1) dispersing each organic filler in a solvent or a resin solution using, for example, a ball mill to prepare organic filler dispersing liquids;

(2) mixing the organic filler dispersing liquids, if desired, together with an additional resin solution to prepare a protective layer coating liquid;

(3) coating the protective layer coating liquid on a recording layer using a conventionally known coating method; and (4) drying the coated liquid to form a protective layer.

The thickness of the protective layer is preferably from about 0.1 to about 20 $\mu$m, and more preferably from about 0.5 to about 10 $\mu$m to maintain good thermosensitivity and good preservability of the thermosensitive recording material, and good ability to be used with thermal printheads.

The recording layer of the thermosensitive recording material, which is formed on a substrate, includes a binder resin, a coloring agent and a coloring developer which forms a color image by reacting with the coloring agent upon application of heat.

Suitable coloring agents which can be used in the recording layer of the thermosensitive recording material of the present invention include electron donors. Any known colorless or pale-colored dye precursors conventionally used in thermosensitive recording materials can be employed alone or in combination. For example, leuco compounds such as triphenylmethanephthalide-, triarylmethane-, fluoran-, phenothiazine-, thiofluoran-, xanthene-, indophthalyl-, spiropyran-, azaphthalide-, chromenopyrazole-, methine-, rhodamineanilinolactam-, rhodaminelactam-, quinazoline-, diazaxanthene- and bislactone-type leuco compounds can preferably be employed.

Specific examples of useful leuco compounds include, but are not limited to:

2-anilino-3-methyl-6-diethylaminofluoran, 2-anilino-3-methyl-6-(di-n-butylamino)fluoran, 2-anilino-3-methyl-6-(N-n-propyl-N-methylamino) fluoran, 2-anilino-3-methyl-6-(N-isopropyl-N-methylamino) fluoran, 2-anilino-3-methyl-6-(N-isobutyl-N-methylamino) fluoran, 2-anilino-3-methyl-6-(N-n-amyl-N-methylamino) fluoran, 2-anilino-3-methyl-6-(N-sec-butyl-N-ethylamino) fluoran, 2-anilino-3-methyl-6-(N-n-amyl-N-ethylamino)fluoran, 2-anilino-3-methyl-6-(N-n-isoamyl-N-ethylamino) fluoran, 2-anilino-3-methyl-6-(N-n-propyl-N-isopropylamino)-fluoran, 2-anilino-3-methyl-6-(N-cyclohexyl-N-methylamino)-fluoran, 2-anilino-3-methyl-6-(N-ethyl-p-toluidino)fluoran, 2-anilino-3-methyl-6-(N-methyl-p-toluidino)fluoran, 2-(m-trichloromethylanilino)-3-methyl-6-diethylamino-fluoran, 2-(m-trifluoromethylanilino)-3-methyl-6-diethylamino-fluoran, 2-(m-trifluoromethylanilino)-3-methyl-6-(N-cyclohexyl-N-methylamino)fluoran, 2-(2, 4-dimethylanilino)-3-methyl-6-diethylaminofluoran, 2-(N-ethyl-p-toluidino)-3-methyl-6-(N-ethylanilino)-fluoran, 2-(N-methyl-p-toluidino)-3-methyl-6-(N-propyl-p-toluidino)fluoran, 2-anilino-6-(N-n-hexyl-N-ethylamino)fluoran, 2-(o-chloroanilino)-6-diethylaminofluoran, 2-(o-bromoanilino)-6-diethylaminofluoran, 2-(o-chloroanilino)-6-dibutylaminofluoran, 2-(o-fluoroanilino)-6-dibutylaminofluoran, 2-(m-trifluoromethylanilino)-6-diethylaminofluoran, 2-(p-acetylanilino)-6-(N-n-amyl-N-n-butylamino) fluoran, 2-benzylamino-6-(N-ethyl-p-toluidino)fluoran, 2-benzylamino-6-(N-methyl-2, 4-dimethylanilino) fluoran, 2-benzylamino-6-(N-ethyl-2, 4-dimethylanilino)fluoran, 2-benzylamino-6-(N-methyl-p-toluidino)fluoran, 2-benzylamino-6-(N-ethyl-p-toluidino)fluoran, 2-(di-p-methylbenzylamino)-6-(N-ethyl-p-toluidino)-fluoran, 2-(α-phenylethylamino)-6-(N-ethyl-p-toluidino)fluoran, 2-methylamino-6-(N-methylanilino)fluoran, 2-methylamino-6-(N-ethylanilino)fluoran, 2-methylamino-6-(N-propylanilino)fluoran, 2-ethylamino-6-(N-methyl-p-toluidino)fluoran, 2-methylamino-6-(N-methyl-2, 4-dimethylanilino) fluoran, 2-ethylamino-6-(N-methyl-2, 4-dimethylanilino)fluoran, 2-dimethylamino-6-(N-methylanilino)fluoran, 2-dimethylamino-6-(N-ethylanilino)fluoran, 2-diethylamino-6-(N-methyl-p-toluidino)fluoran, 2-diethylamino-6-(N-ethyl-p-toluidino)fluoran, 2-dipropylamino-6-(N-methylanilino)fluoran, 2-dipropylamino-6-(N-ethylanilino)fluoran, 2-amino-6-(N-methylanilino)fluoran, 2-amino-6-(N-ethylanilino)fluoran, 2-amino-6-(N-propylanilino)fluoran, 2-amino-6-(N-methyl-p-toluidino)fluoran, 2-amino-6-(N-ethyl-p-toluidino)fluoran, 2-amino-6-(N-propyl-p-toluidino)fluoran, 2-amino-6-(N-methyl-p-ethylanilino)fluoran, 2-amino-6-(N-ethyl-p-ethylanilino)fluoran, 2-amino-6-(N-propyl-p-ethylanilino)fluoran, 2-amino-6-(N-methyl-2, 4-dimethylanilino)fluoran, 2-amino-6-(N-ethyl-2, 4-dimethylanilino)fluoran, 2-amino-6-(N-propyl-2, 4-dimethylanilino)fluoran, 2-amino-6-(N-methyl-p-chloroanilino)fluoran, 2-amino-6-(N-ethyl-p-chloroanilino)fluoran, 2-amino-6-(N-propyl-p-chloroanilino)fluoran, 2, 3-dimethyl-6-dimethylaminofluoran, 3-methyl-6-(N-ethyl-p-toluidino)fluoran, 2-chloro-6-diethylaminofluoran, 2-bromo-6-diethylaminofluoran, 2-chloro-6-dipropylaminofluoran, 3-chloro-6-cyclohexylaminofluoran, 3-bromo-6-cyclohexylaminofluoran, 2-chloro-6-(N-ethyl-N-isoamylamino)fluoran, 2-chloro-3-methyl-6-diethylaminofluoran, 2-anilino-3-chloro-6-diethylaminofluoran, 2-(o-chloroanilino)-3-chloro-6-cyclohexylaminofluoran, 2-(m-trifluoromethylanilino)-3-chloro-6-diethylamino-fluoran, 2-(2, 3-dichloroanilino)-3-chloro-6-diethylaminofluoran, 1, 2-benzo-6-diethylaminofluoran, 1, 2-benzo-6-(N-ethyl-N-isoamylamino)fluoran, 1, 2-benzo-6-dibutylaminofluoran, 1, 2-benzo-6-(N-ethyl-N-cyclohexylamino)fluoran, and 1, 2-benzo-6-(N-ethyl-p-toluidino)fluoran, Suitable coloring developers which can be used in the recording layer of the thermosensitive recording material of the present invention include known coloring developers such as electron acceptors conventionally used in thermosensitive recording materials. They can be employed alone or in combination. Preferred coloring developers are the electron acceptors having a long chain alkyl group which are disclosed, for example, in Japanese Laid-Open Patent Application No. 5-124360, incorporated herein by this reference. For example, organic phosphoric acid compounds, aliphatic carboxylic acid compounds, phenolic compounds, each including an aliphatic group having 12 or more carbon atoms, metal salts of mercaptoacetic acid including an aliphatic group having from 10 to 18 carbon atoms, alkyl esters of caffeic acid having an alkyl group having from 5 to 8 carbon atoms, and acidic phosphoric acid esters including an aliphatic group having 16 or more carbon atoms are preferably employed. The above-mentioned aliphatic group includes a linear alkyl group, a branched alkyl group, a linear alkenyl group and a branched alkenyl group, and may include substituents of, for example, a halogen, an alkoxy group or an ester.

Specific examples of the coloring developers include the following electron acceptors, but are not limited to:

(A) organic phosphoric acid compounds

A preferred organic phosphoric acid compound is represented by the following formula (1):

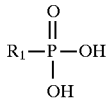

(1)

wherein $R_1$ represents a linear alkyl group having from 12 to 24 carbon atoms.

Specific examples of the compounds represented by the formula (1) are as follows:

dodecyl phosphonate, tetradecyl phosphonate, hexadecyl phosphonate, octadecyl phosphonate, eicosyl phosphonate, docosyl phosphonate, tetracosyl phosphonate, hexacosyl phosphonate, and octacosyl phosphonate.

Another preferred organic phosphoric acid compound is an α-hydroxyalkyl phosphonate compound represented by the following formula (2):

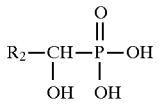

(2)

wherein $R_2$ represents an aliphatic group having from 11 to 29 carbon atoms.

Specific examples of the compounds represented by the formula (2) include the following α-hydroxyalkyl phosphonate:

α-hydroxydodecyl phosphonate,

α-hydroxytetradecyl phosphonate,

α-hydroxyhexadecyl phosphonate,

α-hydroxyoctadecyl phosphonate,

α-hydroxyeicosyl phosphonate,

α-hydroxydocosyl phosphonate, and

α-hydroxytetracosyl phosphonate.

Yet another preferred organic phosphoric compound is an acidic organic phosphoric acid ester compound represented by the following formula (3):

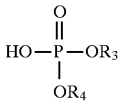

(3)

wherein $R_3$ represents an aliphatic group having 16 or more carbon atoms, and $R_4$ represents a hydrogen atom or an aliphatic group having one or more carbon atoms.

Specific examples of the compounds represented by the formula (3) include:

dihexadecyl phosphate,
dioctadecyl phosphate,
dieicosyl phosphate,
didocosyl phosphate,
monohexadecyl phosphate,
monooctadecyl phosphate,
monoeicosyl phosphate,
monodocosyl phosphate,
methyl hexadecyl phosphate,
methyl octadecyl phosphate,
methyl eicosyl phosphate,
methyl docosyl phosphate,
amyl hexadecyl phosphate,
octyl hexadecyl phosphate, and
lauryl hexadecyl phosphate.

(B) aliphatic carboxylic acid compounds

A preferred aliphatic carboxylic acid compound is an α-hydroxyaliphatic carboxylic acid compound represented by the following formula (4):

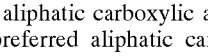

(4)

wherein $R_5$ represents an aliphatic group having 12 or more carbon atoms.

Specific examples of such compounds are as follows:

α-hydroxydecanoic acid,
α-hydroxytetradecanoic acid,
α-hydroxyhexadecanoic acid,
α-hydroxyoctadecanoic acid,
α-hydroxypentadecanoic acid,
α-hydroxyeicosanoic acid,
α-hydroxydocosanoic acid,
α-hydroxytetracosanoic acid,
α-hydroxyhexacosanoic acid, and
α-hydroxyoctacosanoic acid.

Another preferred aliphatic carboxylic acid compound is an aliphatic carboxylic acid compound which has an aliphatic group having 12 or more carbon atoms and a halogen in at least one of its α or β position carbon atoms.

Specific examples of such compounds are as follows:

2-bromohexadecanoic acid,
2-bromoheptadecanoic acid,
2-bromooctadecanoic acid,
2-bromoeicosanoic acid,
2-bromodocosanoic acid,
2-bromotetracosanoic acid,
3-bromooctadecanoic acid,
3-bromoeicosanoic acid,
2, 3-dibromooctadecanoic acid,
2-fluorododecanoic acid,
2-fluorotetradecanoic acid,
2-fluorohexadecanoic acid,
2-fluorooctadecanoic acid,
2-fluoroeicosanoic acid,
2-fluorodocosanoic acid,
2-iodohexadecanoic acid,
2-iodooctadecanoic acid,
3-iodohexadecanoic acid,
3-iodooctadecanoic acid, and
perfluorooctadecanoic acid.

Yet another preferred aliphatic carboxylic acid compound is an aliphatic carboxylic acid compound which has an aliphatic group having 12 or more carbon atoms and an oxo group in at least one of its α, β or γ position carbon atoms.

Specific examples of such compounds are as follows:

2-oxododecanoic acid,
2-oxotetradecanoic acid,
2-oxohexadecanoic acid,
2-oxooctadecanoic acid,
2-oxoeicosanoic acid,
2-oxotetracosanoic acid,
3-oxododecanoic acid,
3-oxotetradecanoic acid,
3-oxohexadecanoic acid,
3-oxooctadecanoic acid,
3-oxoeicosanoic acid,
3-oxotetracosanoic acid,
4-oxohexadecanoic acid,
4-oxooctadecanoic acid, and
4-oxodocosanoic acid.

A further example of the preferred aliphatic carboxylic acid compounds is a dibasic carboxylic acid compound represented by the following formula (5):

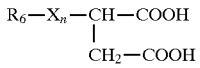

(5)

wherein $R_6$ represents an aliphatic group having 12 or more carbon atoms, X represents an oxygen atom or an sulfur atom, and n is 1 or 2.

Specific examples of such compounds are as follows:

dodecylmalic acid,
tetradecylmalic acid,
hexadecylmalic acid,
octadecylmalic acid,
eicosylmalic acid,
docosylmalic acid,
tetracosylmalic acid,
dodecylthiomalic acid,
tetradecylthiomalic acid,
hexadecylthiomalic acid,
octadecylthiomalic acid,
eicosylthiomalic acid,
docosylthiomalic acid,
tetracosylthiomalic acid,
dodecyldithiomalic acid,
tetradecyldithiomalic acid,
eicosyldithiomalic acid,
docosyldithiomalic acid, and
tetracosyldithiomalic acid.

A still further example of the preferred aliphatic carboxylic acid compounds is a dibasic carboxylic acid compound represented by the following formula (6):

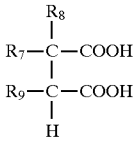

(6)

wherein $R_7$, $R_8$, and $R_9$ independently represent a hydrogen atom or an aliphatic group, and at least one of $R_7$, $R_8$ and $R_9$ is an aliphatic group having 12 or more carbon atoms.

Specific examples of such compounds are as follows:

dodecylbutanedioic acid,
tridecylbutanedioic acid,
tetradecylbutanedioic acid,
pentadecylbutanedioic acid,
octadecylbutanedioic acid,
eicosylbutanedioic acid,
docosylbutanedioic acid,
2, 3-dihexadecylbutanedioic acid,
2, 3-dioctadecylbutanedioic acid,
2-methyl-3-dodecylbutanedioic acid,
2-methyl-3-tetradecylbutanedioic acid,
2-methyl-3-hexadecylbutanedioic acid,
2-ethyl-3-dodecylbutanedioic acid,
2-propyl-3-dodecylbutanedioic acid,
2-octyl-3-hexadecylbutanedioic acid, and
2-tetradecyl-3-octadecylbutanedioic acid.

A still further example of the preferred aliphatic carboxylic acid compounds is a dibasic carboxylic acid compound represented by the following formula (7):

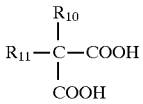

(7)

wherein $R_{10}$ and $R_{11}$ independently represent a hydrogen atom or an aliphatic group, and at least one of $R_{10}$ and $R_{11}$ is an aliphatic group having to 12 or more carbon atoms.

Specific examples of such compounds are as follows:

dodecylmalonic acid,
tetradecylmalonic acid,
hexadecylmalonic acid,
octadecylmalonic acid,
eicosylmalonic acid,
docosylmalonic acid,
tetracosylmalonic acid,
didodecylmalonic acid,
ditetradecylmalonic acid,
dihexadecylmalonic acid,
dioctadecylmalonic acid,
dieicosylmalonic acid,
didocosylmalonic acid,
methyloctadecylmalonic acid,
methyldocosylmalonic acid,
methyltetracosylmalonic acid,
ethyloctadecylmalonic acid,
ethyleicosylmalonic acid,
ethyldocosylmalonic acid, and
ethyltetracosylmalonic acid.

A still further example of the preferred aliphatic carboxylic acid compounds is a dibasic carboxylic acid compound represented by the following formula (8):

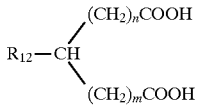

(8)

wherein $R_{12}$ represents an aliphatic group having 12 or more carbon atoms, n is 0 or 1, m is 1, 2 or 3, and provided when n is 0, m is 2 or 3, and provided when n is 1, m is 1 or 2.

Specific examples of such compounds are as follows:

2-dodecyl-pentanedioic acid,
2-hexadecyl-pentanedioic acid,
2-octadecyl-pentanedioic acid,
2-eicosyl-pentanedioic acid,
2-docosyl-pentanedioic acid,
2-dodecyl-hexanedioic acid,
2-pentadecyl-hexanedioic acid,
2-octadecyl-hexanedioic acid,
2-eicosyl-hexanedioic acid, and
2-docosyl-hexanedioic acid.

A still further example of the preferable aliphatic carboxylic acid compounds is a tribasic acid compound which is acylated by a long chain aliphatic acid.

Specific examples of such compounds are as follows:

o-palmitylcitric acid

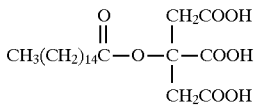

(A)

o-stearylcitric acid

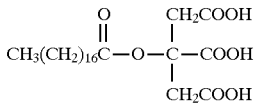

(B)

o-eicosylcitric acid

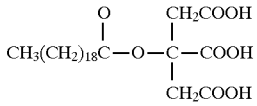

(C)

(C) phenolic compounds

A preferred phenolic compound is a phenolic compound represented by the following formula (9):

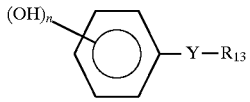

(9)

wherein Y represents —S—,—O—, —CONH— or —COO—, $R_{13}$ represents an aliphatic group having 12 or more carbon atoms and n is 1, 2 or 3.

Specific examples of such compounds are as follows:

p-(dodecylthio)phenol,
p-(tetradecylthio)phenol,
P-(hexadecylthio)phenol,
P-(octadecylthio)phenol,
p-(eicosylthio)phenol, p-(docosylthio)phenol,
p-(tetracosylthio)phenol,
p-(dodecyloxy)phenol,
p-(tetradecyloxy)phenol,
p-(hexadecyloxy)phenol,
p-(octadecyloxy)phenol,
p-(eicosyloxy)phenol,
p-(docosyloxy)phenol,
p-(tetracosyloxy)phenol,
p-dodecylcarbamoylphenol,
p-tetradecylcarbamoylphenol,
p-hexadecylcarbamoylphenol,
p-octadecylcarbamoylphenol,
p-eicosylcarbamoylphenol,
p-docosylcarbamoylphenol,
p-tetracosylcarbamoylphenol,
hexadecyl gallate,
octadecyl gallate,
eicosyl gallate,
docosyl gallate, and
tetracosyl gallate.

Another preferable phenolic compound is a caffeic acid alkyl ester represented by the following formula (10):

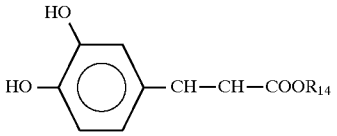

(10)

wherein $R_{14}$ represents an alkyl group having from 5 to 8 carbon atoms.

Specific examples of such compound are as follows:
caffeic acid n-pentyl ester,
caffeic acid n-hexyl ester, and
caffeic acid n-octyl ester.

(D) metal salts of mercaptoacetic acid

A preferred metal salt of mercaptoacetic acid is a metal salt of alkyl- or alkenyl-mercaptoacetic acid represented by the following formula (11):

$$(R_{15}—S—CH_2—COO)_2M \quad (11)$$

wherein $R_{15}$ represents an aliphatic group having from 10 to 18 carbon atoms, and M represents Sn, Mg, Zn or Cu.

Specific examples of such compounds are as follows:
Sn salt of decylmercaptoacetic acid,
Sn salt of dodecylmercaptoacetic acid,
Sn salt of tetradecylmercaptoacetic acid,
Sn salt of hexadecylmercaptoacetic acid,
Sn salt of octadecylmercaptoacetic acid,
Mg salt of decylmercaptoacetic acid,
Mg salt of dodecylmercaptoacetic acid,
Mg salt of tetradecylmercaptoacetic acid,
Mg salt of hexadecylmercaptoacetic acid,
Mg salt of octadecylmercaptoacetic acid,
Zn salt of decylmercaptoacetic acid,
Zn salt of dodecylmercaptoacetic acid,
Zn salt of tetradecylmercaptoacetic acid,
Zn salt of hexadecylmercaptoacetic acid,
Zn salt of octadecylmercaptoacetic acid,
Cu salt of decylmercaptoacetic acid,
Cu salt of dodecylmercaptoacetic acid,
Cu salt of tetradecylmercaptoacetic acid,
Cu salt of hexadecylmercaptoacetic acid, and
Cu salt of octadecylmercaptoacetic acid.

Among these coloring developers, organic phosphoric acid compounds are preferable because of having good resistance to color formation by dissolving in a protective layer coating solvent, good thermosensitivity, good image density and good ability to be used with thermal printheads.

The content of the coloring developer is preferably from about 1 to about 20 parts by weight, and more preferably from about 2 to about 10 parts by weight, per 1 part by weight of the coloring agent in the thermosensitive coloring layer.

The coating solution of the protective layer often includes an organic solvent such as toluene, methyl ethyl ketone and alcohols which is used for dissolving a binder resin of the protective layer. When the organic solvent contacts the previously formed recording layer, undesired color formation occurs because the coloring agent and the coloring developer in the recording layer dissolve in the solvent and react to form a colored substance. In order to avoid this problem, one or more of the following methods can preferably be used:

(1) using a coloring agent and a coloring developer, at least one of which does not dissolve or hardly dissolves in the solvent used for the protective layer coating liquid;
(2) microencapsulating at least one of a coloring agent and a coloring developer to prevent the coloring agent from contacting the coloring developer; and/or
(3) forming a resin layer between a recording layer and a protective layer to prevent the recording layer from contacting a protective layer coating liquid.

A suitable binder resin for use in the recording layer includes known resins, such as polyacrylamide, maleic acid copolymers, polyacrylates, polymethacrylates, vinyl chloride-vinyl acetate copolymers, styrene copolymers, polyesters, polyurethanes, polyvinyl butyral, ethyl cellulose, polyvinyl acetal, polyvinyl acetoacetal, polycarbonate, epoxy resins and polyamides.

The recording layer may include auxiliary agents such as fillers, pigments, surfactants and thermofusible agents, if necessary.

The recording layer of the thermosensitive recording material of the present invention can be formed, for example, by the following method:

(1) dispersing or dissolving a coloring agent, a coloring developer and a binder resin in water and/or an organic solvent to prepare a recording layer coating liquid;
(2) coating the recording layer coating liquid on a substrate by a conventionally known coating method; and
(3) drying the coated liquid to form a recording layer.

When a coloring developer dispersing liquid is used for the recording layer coating liquid, the surface smoothness of the recording layer, which affects the dots reproducibility of recorded images, depends on the particle diameter of the coloring developer and therefore the preferred particle diameter is less than about 0.5 $\mu$m. The preferred thickness of the recording layer, which depends on the formulation of the recording layer and the use of the thermosensitive recording material, is from about 1 to about 50 $\mu$m, and more preferably from about 3 to about 20 $\mu$m. If desired, the recording layer coating liquid may include additives such as a surfactant which improves the coating properties, thereby allowing the thermosensitive recording material to produce images having good image qualities.

The thermosensitive recording material may further include an intermediate layer containing a filler, a binder and a thermofusible material which is formed between the substrate and the recording layer to make the surface of the thermosensitive recording material smooth.

Substrates suitable for use in the thermosensitive recording material of the present invention include but are not limited to:

polyester films such as polyethyleneterephthalate and polybutyleneterephthalate, cellulose films such as cellulose triacetate, polyolefin films such as polyethylene and polypropylene, polystyrene films, paper, and synthetic paper.

These films are used alone or in combination in which a plurality of these films are laminated to each other.

Suitable recording methods for recording images on the thermosensitive recording material of the present invention include any conventional recording methods using, for example, a thermal pen, a thermal printhead and laser beams.

In addition, the thermosensitive recording material of the present invention may be a transparent thermosensitive recording material or an opaque thermosensitive recording material.

Further, the thermosensitive recording material of the present invention may be an irreversible thermosensitive recording material or a reversible thermosensitive recording material.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

(Formation of recording layer)

A mixture of the following compounds was pulverized and dispersed in a ball mill in order that the average particle diameter of the solid components in the liquid was 0.3 μm, thus a Liquid A, i.e., a recording layer coating liquid, was prepared:

| (Liquid A) | |
|---|---|
| 3-diethylamino-6-methyl-7-anilinofluoran | 4 |
| octadecyl phosphonate | 12 |
| polyvinyl butyral (Denka Butyral #3000-2, manufactured by Denki Kagaku Kogyo K. K.) | 6 |
| toluene | 57 |
| methyl ethyl ketone | 57 |

The liquid A was coated on a substrate of a polyethylene terephthalate (PET) film 75 μm thick, and dried to form a recording layer of 10 μm in a dry thickness. The smoothness of the surface of the recording layer was 7,000 sec.

(Formation of protective layer)

The following compounds were mixed and dispersed in a ball mill to prepare a Liquid B:

| (Liquid B) | |
|---|---|
| melamine-formaldehyde copolymer particles (Epostar S, manufactured by Nippon Shokubai Co., Ltd., average particle diameter of 0.3 μm) | 30 |
| 10% polyvinyl acetoacetal resin solution (KS-1 manufactured by Sekisui Chemical Co., Ltd. was dissolved in methyl ethyl ketone) | 30 |
| methyl ethyl ketone | 140 |

The following compounds were mixed and dispersed in a ball mill to prepare a Liquid C:

| (Liquid C) | |
|---|---|
| guanamine-formaldehyde copolymer particles (Epostar M30, manufactured by Nippon Shokubai Co., Ltd., average particle diameter of 3.0 μm) | 30 |
| 10% polyvinyl acetoacetal resin solution (KS-1 manufactured by Sekisui Chemical Co., Ltd. was dissolved in methyl ethyl ketone) | 30 |
| methyl ethyl ketone | 140 |

The following compounds were mixed to prepare a Liquid D, i.e., a protective layer coating liquid:

| (Liquid D) | |
|---|---|
| Liquid B | 150 |
| Liquid C | 5 |
| silicone modified polyvinyl butyral resin (SP-712, manufactured by Dainichiseika Color & Chemical Mfg. Co., Ltd., solid content of 12.5%) | 20 |
| 5% polyvinyl acetoacetal solution (KS-5 having a degree of polymerization of 2,400, manufactured by Sekisui Chemical Co., Ltd., was dissolved in methyl ethyl ketone) | 53 |
| methylenediisocyanate derivatives (Colonate HX, manufactured by Nippon Polyurethane Industry Co., Ltd.) | 1 |
| methyl ethyl ketone | 110 |
| toluene | 77 |

The liquid D was coated on the previously prepared recording layer, and dried to form a protective layer of 1.5 μm in a dry thickness. The average particle diameter of the relatively large organic filler, i.e., Epostar M30, was 2.0 times the thickness of the protective layer. Thus, a thermosensitive recording material of the present invention was obtained.

Example 2

(Formation of recording layer)

The procedure for preparation of the recording layer in Example 1 was repeated to obtain a recording layer formed on a PET film.

(Formation of protective layer)

The following compounds were mixed and dispersed in a ball mill to prepare a Liquid E:

| (Liquid E) | |
|---|---|
| melamine-formaldehyde copolymer particles (Epostar S6, manufactured by Nippon Shokubai Co., Ltd., average particle diameter of 0.6 μm) | 30 |

-continued

| (Liquid E) | |
|---|---|
| 10% polyvinyl acetoacetal resin solution (KS-1 manufactured by Sekisui Chemical Co., Ltd. was dissolved in methyl ethyl ketone) | 30 |
| methyl ethyl ketone | 140 |

The following compounds were mixed and dispersed in a ball mill to prepare a Liquid F:

| (Liquid F) | |
|---|---|
| crosslinked polymethyl methacrylate particles (Epostar MA1004, manufactured by Nippon Shokubai Co., Ltd., average particle diameter of 4.0 μm) | 30 |
| 10% polyvinyl acetoacetal resin solution (KS-1 manufactured by Sekisui Chemical Co., Ltd. was dissolved in methyl ethyl ketone) | 30 |
| methyl ethyl ketone | 140 |

The following compounds were mixed to prepare a Liquid G, i.e., a protective layer coating liquid:

| (Liquid G) | |
|---|---|
| Liquid E | 100 |
| Liquid F | 2.5 |
| silicone modified polyvinyl butyral resin (SP-712, manufactured by Dainichiseika Color & Chemical Mfg. Co., Ltd., solid content of 12.5%) | 20 |
| 5% polyvinyl acetoacetal solution (KS-1 having a degree of polymerization of 500, manufactured by Sekisui Chemical Co., Ltd., was dissolved in methyl ethyl ketone) | 69 |
| methyl ethyl ketone | 92 |
| toluene | 65 |

The liquid G was coated on the previously prepared recording layer, and dried to form a protective layer of 3 μm in a dry thickness. The average particle diameter of the relatively large organic filler, i.e., Epostar M1004, was 1.3 times the thickness of the protective layer. Thus, a thermosensitive recording material of the present invention was obtained.

Example 3

(Formation of intermediate layer)

An intermediate coating layer including an inorganic pigment having an average particle diameter of 6 μm and a resin was coated on a polyethylene terephthalate film having a thickness of 75 μm and dried to form an intermediate layer.

(Formation of recording layer)

The procedure for preparation of the recording layer in Example 1 was repeated to form a recording layer on the previously prepared intermediate layer. The smoothness of the surface of the recording layer was 500 sec.

(Formation of protective layer)

The procedure for preparation of the protective layer in Example 2 was repeated to form a protective layer on the previously prepared recording layer. The average particle diameter of the relatively large organic filler, i.e., Epostar M1004, was 1.3 times the thickness of the protective layer.

Thus, a thermosensitive recording material of the present invention was obtained.

Example 4

(Formation of recording layer)

The procedure for preparation of the recording layer in Example 1 was repeated to obtain a recording layer formed on a PET film.

(Formation of protective layer)

The following compounds were mixed and dispersed in a ball mill to prepare a Liquid H:

| (Liquid H) | |
|---|---|
| crosslinked polymethyl methacrylate particles (Epostar MA1006, manufactured by Nippon Shokubai Co., Ltd., average particle diameter of 6.0 μm) | 30 |
| 10% polyvinyl acetoacetal resin solution (KS-1 manufactured by Sekisui Chemical Co., Ltd. was dissolved in methyl ethyl ketone) | 30 |
| methyl ethyl ketone | 140 |

The following compounds were mixed to prepare a Liquid I, i.e., a protective layer coating liquid:

| (Liquid I) | |
|---|---|
| Liquid B | 150 |
| Liquid H | 5 |
| silicone modified polyvinyl butyral resin (SP-712, manufactured by Dainichiseika Color & Chemical Mfg. Co., Ltd., solid content of 12.5%) | 20 |
| 5% polyvinyl acetoacetal solution (KS-1 having a degree of polymerization of 500, manufactured by Sekisui Chemical Co., Ltd., was dissolved in methyl ethyl ketone) | 53 |
| methyl ethyl ketone | 110 |
| toluene | 77 |

The liquid I was coated on the previously prepared recording layer, and dried to form a protective layer of 2 μm in a dry thickness. The average particle diameter of the relatively large organic filler, i.e., Epostar M1006, was 3.0 times the thickness of the protective layer. Thus, a thermosensitive recording material of the present invention was obtained.

Example 5

(Formation of recording layer)

The procedure for preparation of the recording layer in Example 1 was repeated to obtain a recording layer formed on a PET film.

(Formation of protective layer)

The following compounds were mixed and dispersed in a ball mill to prepare a Liquid J:

| (Liquid J) | |
|---|---|
| crosslinked polymethyl methacrylate particles (Epostar MA08W, manufactured by Nippon Shokubai Co., Ltd., average particle diameter of 0.08 μm) | 30 |
| 10% polyvinyl acetoacetal resin solution (KS-1 manufactured by Sekisui Chemical Co., Ltd. was dissolved in methyl ethyl ketone) | 30 |
| methyl ethyl ketone | 140 |

The following compounds were mixed to prepare a Liquid K, i.e., a protective layer coating liquid:

| (Liquid K) | |
|---|---|
| Liquid J | 100 |
| Liquid C | 5 |
| silicone modified polyvinyl butyral resin (SP-712, manufactured by Dainichiseika Color & Chemical Mfg. Co., Ltd., solid content of 12.5%) | 20 |
| 5% polyvinyl acetoacetal solution | 73 |

-continued

| (Liquid K) | |
|---|---|
| (KS-1 having a degree of polymerization of 500, manufactured by Sekisui Chemical Co. Ltd., was dissolved in methyl ethyl ketone) | |
| methyl ethyl ketone | 70 |
| toluene | 37 |

The liquid K was coated on the previously prepared recording layer, and dried to form a protective layer of 2 μm in a dry thickness. The average particle diameter of the relatively large organic filler, i.e., Epostar M30, was 1.5 times the thickness of the protective layer. Thus, a thermosensitive recording material of the present invention was obtained.

Comparative Example 1

(Formation of recording layer)

The procedure for preparation of the recording layer in Example 1 was repeated to obtain a recording layer formed on a PET film.

(Formation of protective layer)

The following compounds were pulverized and dispersed in a ball mill in order that the average particle diameter of the solid components in the liquid was 0.3 μm, thus a Liquid L was prepared:

| (Liquid L) | |
|---|---|
| silica powder (Mizukasil P-832, manufactured by Mizusawa Industrial Chemicals Ltd.) | 30 |
| silicone modified polyvinyl butyral resin (SP-712, manufactured by Dainichiseika Color & Chemical Mfg. Co., Ltd., solid content of 12.5%) | 24 |
| methyl ethyl ketone | 146 |

The following compounds were mixed to prepare a Liquid M, i.e., a protective layer coating liquid:

| (Liquid M) | |
|---|---|
| Liquid C | 2.4 |
| Liquid L | 24 |
| silicone modified polyvinyl butyral resin (SP-712, manufactured by Dainichiseika Color & Chemical Mfg. Co., Ltd., solid content of 12.5%) | 70 |
| methyl ethyl ketone | 88 |

The liquid M was coated on the previously prepared recording layer, and dried to form a protective layer of 1.5 μm in a dry thickness. The average particle diameter of the relatively large organic filler, i.e., Epostar M30, was 2.0 times the thickness of the protective layer. Thus, a comparative thermosensitive recording material was obtained.

Comparative Example 2

(Formation of recording layer)

The procedure for preparation of the recording layer in Example 1 was repeated to obtain a recording layer formed on a PET film.

(Formation of protective layer)

The following compounds were mixed and dispersed in a ball mill to prepare a Liquid N:

| (Liquid N) | |
|---|---|
| crosslinked polymethyl methacrylate particles (Epostar MA1010, manufactured by Nippon Shokubai Co., Ltd., average particle diameter of 10 μm) | 30 |
| 10% polyvinyl acetoacetal resin solution (KS-1 manufactured by Sekisui Chemical Co., Ltd. was dissolved in methyl ethyl ketone) | 30 |
| methyl ethyl ketone | 140 |

The following compounds were mixed to prepare a Liquid O, i.e., a protective layer coating liquid:

| (Liquid O) | |
|---|---|
| Liquid E | 100 |
| Liquid N | 10 |
| silicone modified polyvinyl butyral resin (SP-712, manufactured by Dainichiseika Color & Chemical Mfg. Co., Ltd., solid content of 12.5%) | 25 |
| 5% polyvinyl acetoacetal solution (KS-1 having a degree of polymerization of 500, manufactured by Sekisui Chemical Co., Ltd., was dissolved in methyl ethyl ketone) | 53 |
| methyl ethyl ketone | 40 |
| toluene | 10 |

The liquid O was coated on the previously prepared recording layer, and dried to form a protective layer of 3μm in a dry thickness. The average particle diameter of the relatively large organic filler, i.e., Epostar MA1010, was 3.3 times the thickness of the protective layer. Thus, a comparative thermosensitive recording material was obtained.

Comparative Example 3

(Formation of recording layer)

The procedure for preparation of the recording layer in Example 1 was repeated to obtain a recording layer formed on a PET film.

(Formation of protective layer)

The following compounds were mixed and dispersed in a ball mill to prepare a Liquid P:

| (Liquid P) | |
|---|---|
| crosslinked polymethyl methacrylate particles (Epostar MA1001, manufactured by Nippon Shokubai Co., Ltd., average particle diameter of 1 μm) | 30 |
| 10% polyvinyl acetoacetal resin solution (KS-1 manufactured by Sekisui Chemical Co., Ltd. was dissolved in methyl ethyl ketone) | 30 |
| methyl ethyl ketone | 140 |

The following compounds were mixed to prepare a Liquid Q, i.e., a protective layer coating liquid:

| (Liquid Q) | |
|---|---|
| Liquid P | 150 |
| Liquid C | 5 |
| silicone modified polyvinyl butyral resin (SP-712, manufactured by Dainichiseika Color & Chemical Mfg. Co., Ltd., solid content of 12.5%) | 20 |
| 5% polyvinyl acetoacetal solution (KS-1 having a degree of polymerization of 500, manufactured by Sekisui Chemical Co., Ltd., was dissolved in methyl lethyl ketone) | 53 |

-continued

| (Liquid Q) | |
|---|---|
| methyl ethyl ketone | 110 |
| tluene | 77 |

The liquid Q was coated on the previously prepared recording layer, and dried to form a protective layer of 2 μm in a dry thickness. The average particle diameter of the relatively large organic filler, i.e., Epostar M30, was 1.5 times the thickness of the protective layer. Thus, a comparative thermosensitive recording material was obtained.

Comparative Example 4

(Formation of recording layer)

The procedure for preparation of the recording layer in Example 1 was repeated to obtain a recording layer formed on a PET film.

(Formation of protective layer)

The following compounds were mixed to prepare a Liquid R, i.e., a protective layer coating liquid:

| (Liquid R) | |
|---|---|
| Liquid E | 150 |
| Liquid C | 5 |
| silicone modified polyvinyl butyral resin (SP-712, manufactured by Dainichiseika Color & Chemical Mfg. Co., Ltd., solid content of 12.5%) | 20 |
| 5% polyvinyl acetoacetal solution (KS-1 having a degree of polymerization of 500, manufactured by Sekisui Chemical Co., Ltd., was dissolved in methyl ethyl ketone) | 53 |
| methyl ethyl ketone | 110 |
| toluene | 77 |

The liquid R was coated on the previously prepared recording layer, and dried to form a protective layer of 3 μm in a dry thickness. The average particle diameter of the relatively large organic filler, i.e., Epostar M30, was 1.0 times the thickness of the protective layer. Thus, a comparative thermosensitive recording material was obtained.

Comparative Example 5

(Formation of recording layer)

The procedure for preparation of the recording layer in Example 1 was repeated to obtain a recording layer formed on a PET film.

(Formation of protective layer)

The following compounds were mixed and dispersed in a ball mill to prepare a Liquid S:

| (Liquid S) | |
|---|---|
| crosslinked polymethyl methacrylate particles (Epostar MA03W, manufactured by Nippon Shokubai Co., Ltd., average particle diameter of 0.035 μm) | 30 |
| 10% polyvinyl acetoacetal resin solution (KS-1 manufactured by Sekisui Chemical Co., Ltd. was dissolved in methyl ethyl ketone) | 30 |
| methyl ethyl ketone | 140 |

The following compounds were mixed to prepare a Liquid T, i.e., a protective layer coating liquid:

| (Liquid T) | |
|---|---|
| Liquid S | 100 |
| Liquid C | 10 |
| silicone modified polyvinyl butyral resin (SP-712, manufactured by Dainichiseika Color & Chemical Mfg. Co., Ltd., solid content of 12.5%) | 60 |
| 5% polyvinyl acetoacetal solution (KS-1 having a degree of polymerization of 500, manufactured by Sekisui Chemical Co., Ltd., was dissolved in methyl ethyl ketone) | 162 |

The liquid T was coated on the previously prepared recording layer, and dried to form a protective layer of 2 μm in a dry thickness. The average particle diameter of the relatively large organic filler, i.e., Epostar M30, was 1.5 times the thickness of the protective layer. Thus, a comparative thermosensitive recording material was obtained.

The obtained thermosensitive recording materials of Examples 1 to 5 and Comparative Examples 1 to 5 were evaluated by the following methods.

(1)white streaks

Each thermosensitive recording material was set in a thermal recording simulator manufactured by Ohkura Electric Co., Ltd. and three solid images were recorded using the following recording conditions:

dot density of the thermal printhead used: 8 dots/mm applied electric power: 0.68 W/dot cycle time: 10 msec/line pulse width: 0.30 msec recording length: 30 cm recording width: 20 cm Total number of white streaks in the three solid images was counted and divided by three to obtain the number of white streaks per one solid image.

(2) sticking

The image recording procedure for evaluation of white streaks was repeated except that the pulse width was 0.5 msec.

Noise caused by sticking of each thermosensitive recording material to the thermal printhead during image recording was evaluated and classified as follows:

○: little or no sticking noise was made

Δ: a little sticking noise was made

X: harsh sticking noise was made (3) peeling of protective layer

Each thermosensitive recording material was set in a thermal recording simulator manufactured by Ohkura Electric Co., Ltd., and a solid image was recorded using the following recording conditions:

dot density of the thermal printhead used: 8 dots/mm applied electric power: 0.68 W/dot cycle time: 10 msec/line pulse width: changed from 0.20 msec to 1.2 msec at 0.1 msec intervals The image recorded thermosensitive recording material was visually observed to determine whether the protective layer of the recorded area was peeled. The pulse width at which peeling of the protective layer began to occur was shown in Table 1.

(4) evenness of dot images

Each thermosensitive recording material was set in a thermal recording simulator manufactured by Ohkura Electric Co., Ltd., and a solid image was recorded by the same recording conditions as those in the evaluation of the white streaks. Recorded dot images consisting of the solid images were visually observed with a microscope and classified as follows:

○: having good reproducibility (reproducibility and evenness of the recorded dot images were good)

Δ: having acceptable reproducibility (reproducibility and evenness of the recorded dot images were slightly deteriorated)

X: having bad reproducibility (reproducibility and evenness of the recorded dot images were deteriorated)

(5) abrasion of thermal printhead

Each thermosensitive recording material was set in a thermal recording simulator manufactured by Ohkura Electric Co., Ltd., and a solid image was recorded using the following conditions:

dot density of the thermal printhead used: 8 dots/mm
applied electric power: 0.68 W/dot
cycle time: 10 msec/line
pulse width: 0.30 msec
recording length: 5 cm
recording width: 3 cm After this solid image was repeatedly recorded on one kilometer length of each thermosensitive recording material, decrease of height of a heating part of the thermal printhead was measured.

The results are shown in Table 1.

TABLE 1

| | white streak | sticking | peeling of protective layer | evenness of dot images | abrasion of thermal printhead |
|---|---|---|---|---|---|
| Example 1 | 0 | ○ | no peeling | ○ | 0.00 μm |
| Example 2 | 1 | ○ | 1.1 ms | ○ | — |
| Example 3 | 3 | ○ | 1.1 ms | Δ | — |
| Example 4 | 0 | ○ | 1.1 ms | Δ | — |
| Example 5 | 3 | ○ | 1.0 ms | ○ | — |
| Comparative Example 1 | 1 | Δ | 1.1 ms | ○ | 0.05 μm |
| Comparative Example 2 | 5 | Δ | 0.9 ms | X | — |
| Comparative Example 3 | 3 | Δ | 1.1 ms | X | — |
| Comparative Example 4 | 5 | X | 0.8 ms | ○ | — |
| Comparative Example 5 | 15 | X | 0.7 ms | ○ | — |

The results in Table 1 clearly indicate that the thermosensitive recording material of the present invention exhibits good image qualities and has good ability to be used with the thermal printhead.

Additional modifications and variations of the present invention are possible in light of the above teachings. It is therefore to be understood that within the scope of the appended claims the invention may be practiced other than as specifically described herein.

This application is based on Japanese Patent Application No. 08-207842, filed on Jul. 18, 1996, the entire contents of which are herein incorporated by reference.

What is claimed is:

1. A thermosensitive recording material which comprises a substrate, a thermosensitive recording layer formed overlying the substrate and comprising a binder resin, a coloring agent and a coloring developer inducing color formation by a reaction with the coloring agent upon application of heat thereto, and a protective layer formed on the thermosensitive recording layer and comprising a resin, said protective layer having a thickness, wherein the protective layer further comprises a particulate organic filler (A) whose average particle diameter is from about 1.2 to about 3.0 times the thickness of the protective layer and a particulate organic filler (B) having an average particle diameter of from about 0.05 to about 0.7 μm.

2. The thermosensitive recording material of claim 1, wherein the ratio of the organic filler (A) to the organic filler (B) is from about 1:100 to about 1:20 by weight.

3. The thermosensitive recording material of claim 1, wherein the ratio of the resin to the total amount of the organic filler (A) and the organic filler (B) in the protective layer is from about 1:0.5 to about 1:6 by weight.

4. The thermosensitive recording material of claim 1, wherein at least one of the organic filler (A) and the organic filler (B) comprises a guanamine-formaldehyde copolymer having the following formula (I):

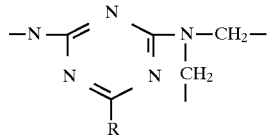

(I)

wherein R represents H, $CH_3$, $C_2H_5$, $C_3H_7$, $C_4H_9$, $NH_2$, $NO_2$, an acetyl group, $C_6H_{11}$, $C_6H_5$, a benzyl group or a methylphenyl group.

5. The thermosensitive recording material of claim 1, wherein at least one of the organic filler (A) and the organic filler (B) comprises a melamine-formaldehyde copolymer.

6. The thermosensitive recording material of claim 1, wherein the resin in the protective layer comprises a polyvinyl acetoacetal resin having a degree of polymerization more than about 2,000 and the protective layer further comprises an isocyanate compound which crosslinks the polyvinyl acetoacetal resin.

7. The thermosensitive recording material of claim 1, wherein the protective layer is formed on a surface having a smoothness greater than about 5,000 sec.

8. The thermosensitive recording material of claim 1, wherein the coloring agent is an electron donor and the coloring developer is an electron acceptor.

9. The thermosensitive recording material of claim 1, wherein the coloring developer is an organic phosphoric compound.

10. The thermosensitive recording material of claim 1, wherein the protective layer is formed by applying a coating of a protective layer coating liquid comprising an organic solvent, the resin, the organic filler (A) and the organic filler (B), and drying the applied coating of the protective layer coating liquid, and wherein at least one of the coloring agent and the coloring developer in the thermosensitive recording layer is insoluble or hardly soluble to the organic solvent.

11. The thermosensitive recording material of claim 1, wherein the protective layer is formed by applying a coating of a protective layer coating liquid comprising an organic solvent, the resin, the organic filler (A) and the organic filler (B), and drying the applied coating of the protective layer coating liquid, and wherein at least one of the coloring agent and the coloring developer in the thermosensitive recording layer is microencapsulated.

12. The thermosensitive recording material of claim 1, wherein the thermosensitive recording material further comprises a resin layer formed between the thermosensitive recording layer and the protective layer, and the protective layer is formed by coating a protective layer coating liquid comprising an organic solvent, the resin, the organic filler (A) and the organic filler (B), and drying the coated protective layer coating liquid.

13. The thermosensitive recording material of claim 1, wherein the resin in the protective layer comprises a silicone modified resin.

14. The thermosensitive recording material of claim 1, wherein the thickness of the protective layer is from about 0.5 to about 10 $\mu$m.

15. The thermosensitive recording material of claim 1, wherein the thickness of the thermosensitive recording layer is from about 3 to about 20 $\mu$m.

16. The thermosensitive recording material of claim 1, wherein the coloring developer is particulate and has an average particle diameter less than about 0.5 $\mu$m.

17. The thermosensitive recording material of claim 1, wherein the ratio of the coloring agent to the coloring developer in the thermosensitive recording layer is from about 1:2 to about 1:10 by weight.

* * * * *